United States Patent [19]

Teckentrup et al.

[11] Patent Number: 4,507,926

[45] Date of Patent: Apr. 2, 1985

[54] ROTOR ROTATING DEVICE FOR DRIVING OR DRIVEN MACHINES

[75] Inventors: Hermann Teckentrup, Oberasbach; Wilhelm Hoffmann, Nuremberg, both of Fed. Rep. of Germany

[73] Assignee: AEG-Kanis Turbinenfabrik GmbH, Nüremberg, Fed. Rep. of Germany

[21] Appl. No.: 492,238

[22] Filed: May 6, 1983

[51] Int. Cl.[3] ..... F01K 25/08

[52] U.S. Cl. ..... 60/656; 60/721; 60/39.142; 74/6; 192/67 R; 192/85 C; 415/122 R

[58] Field of Search ..... 60/656, 721, 39.142; 192/85 C, 67 R; 74/467, 346, 6, 8; 415/122 R

[56] References Cited

U.S. PATENT DOCUMENTS

| | | | |
|---|---|---|---|
| 2,245,175 | 6/1941 | Bany | 74/8 X |
| 2,614,798 | 10/1952 | Rubbra | 415/122 R |
| 2,968,914 | 1/1961 | Birmann | 60/39.142 X |
| 3,269,703 | 8/1966 | Durdin et al. | 415/122 |
| 3,472,024 | 10/1969 | Strub et al. | 60/39.142 X |
| 3,831,381 | 8/1974 | Swearingen | 60/657 |
| 4,030,296 | 6/1977 | Deinlein-Kalb | 60/656 |
| 4,437,809 | 3/1984 | Nutter | 60/646 X |

*Primary Examiner*—Allen M. Ostrager
*Attorney, Agent, or Firm*—Spencer & Frank

[57] ABSTRACT

A rotor rotating device connected to an oil supply system for turning the rotor of a rotary machine, which rotor is fitted with a gear wheel, the device including: a hydraulic motor; a hub mounted to be rotated by the motor; a pinion mounted on the hub and dimensioned to mesh with the gear wheel; a screw shift drive operatively associated with the pinion for permitting movement of the pinion in the direction of the axis of rotation of the hub between a first position in which the pinion is disengaged from the gear wheel and a second position in which the pinion meshes with the gear wheel; a compression spring disposed to urge the pinion toward the first position; and a piston connected to the pinion and arranged to be actuated by oil under pressure from the oil supply system for moving the pinion into the second position.

8 Claims, 2 Drawing Figures

ROTOR ROTATING DEVICE FOR DRIVING OR DRIVEN MACHINES

BACKGROUND OF THE INVENTION

The present invention relates to a rotor rotating device of the type employed for turning driving or driven machines.

Such a rotor rotating device serves to slowly rotate the machine shaft of turbines or compressors which are subjected to high operating temperatures. If such machines are stopped, the rotors must be prevented from bending through and no longer being balanced or contacting their stators when fully cooled. For that reason, the rotors are turned during their cooling phase, i.e. kept rotating at slow speed until they are completely cooled. The rotor rotating device also serves to overcome the breakaway moment before the subsequent turning of the rotor during the cooling phase and when they are to be started up.

In a device of this type for rotating the rotors, as disclosed in German Pat. No. 926,133, the main oil pump of the oil supply system, which in normal operation is driven directly or indirectly via a gear unit by the rotor of the driven or driving machine, can be switched from its normal operation as a driven machine to that of a driving machine which will rotate the rotor when supplied with oil under pressure. An externally driven auxiliary oil pump of the oil system then furnishes the pressurized oil to the main oil pump which is now working as a hydraulic motor.

If it is assumed that the oil supply system of a machine is very complex per se since the oil, in addition to lubricating the bearings, also serves as a control oil for the most varied regulating devices, an additional reversal of the operation of the main oil pump to that of a hydraulic motor involves a further considerable scope of technical work in the circuit arrangement of the entire oil circulation system of the machine assembly.

SUMMARY OF THE INVENTION

It is therefore an object of the present invention to provide a rotor rotating device of the above-mentioned type which is as simple in design as possible and which, in a modification as an individual assembly, can easily be connected without difficulty to an existing oil supply system and is highly stable in its operational sequences.

The above and other objects are achieved, according to the present invention, by the provision of a rotor rotating device arranged to be connected to an oil supply system for turning the rotor of a rotary machine, which rotor is filled with a gear wheel. The device is composed of: a hydraulic motor; a hub mounted to be rotated by the motor; a pinion mounted on the hub and dimensioned to mesh with the gear wheel; a screw shift drive operatively associated with the pinion for permitting movement of the pinion in the direction of the axis of rotation of the hub between a first position in which the pinion is disengaged from the gear wheel and a second position in which the pinion meshes with the gear wheel; a compression spring disposed to urge the pinion toward the first position; and a piston connected to the pinion and arranged to be actuated by oil under pressure from the oil supply system for moving the pinion into the second position.

The advantage of the present invention is obvious from a consideration of a preferred embodiment according to which the pinion is moved axially by the piston via the screw shift, drive and is rotated by an axial piston motor. The dimensioning of the axial piston motor depends essentially on whether the rotor to be turned is jacked up by pressure oil, i.e. a correspondingly high oil pressure is supplied to the shaft bearings before start-up to compensate for the weight of the rotor, or if the axial piston motor has to start without jacking oil. The correspondingly developing breakaway moments define the size of the axial piston motor. The axial piston motor itself is charged with the pressurized oil furnished by the cell-type vane pump. This oil flows back to the oil supply system after being expanded.

On principal, lube oil is supplied to the turbine bearings at a pressure between 7.8 and 4.0 bar. This lube oil serves to dissipate the heat developed in the turbine and to build up the required dynamic lube oil film.

In addition, pressure oil at 80 ./. 100 bar can be admitted vertically between shaft journal and bearing sleeve from below to lift the shaft hydrostatically. (Jacking oil). Jacking oil is admitted at standstill and at low speeds when no hydrodynamic oil film has yet been built up, in order to reduce drastically the friction between shaft and bearing sleeve at this stage.

"Break-away" describes the process when the shaft starts rotating from standstill conditions. Without jacking oil, the required torque (break-away moment) would be considerably higher than it is with jacking oil supply, because practically "dry" friction would exist and a lube-oil film would first have to be built up.

The rotor rotating device according to the invention operates as follows:

The adjustable cell-type vane pump is set to a minimum pump discharge of approximately 4–5 l/min and brings the pressurized oil to an idling pressure of about 10–11 bar. The rotor rotating device rotates at 10 rpm, which corresponds to about 50 mm/s at the pitch circle of the pinion. After or shortly before standstill of the rotor, the piston pushes the pinion to the gear wheel to be driven. As soon as the teeth begin to mesh, the screw shift drive becomes active until pinion and gear wheel mesh completely.

Through the action of the screw shift drive, the turning moment holds the pinion in its position. At the moment of breakaway, the oil pressure rises to 180 bar. The turning speed after breakaway is increased at a developing lower pressure by an increase in the pump discharge flow. It will be about 100 rpm at 40 l/min. When the pinion has reached its end position, the oil supply to the piston is shut off. The oil for the pump as well as for the piston is taken from the oil supply system. During run-up of the machine, disengagement occurs by way of an axial displacement of the pinion, i.e. via the steep thread of the screw shift drive and the compression spring.

Another advantage of the rotor rotating device according to the invention is seen in the possibility of being able to manually rotate the machine rotor, for example for repairs at the blading of a turbine or if there is an interruption in the mains current. For this purpose, a hand pump is arranged parallel to the cell-type vane pump. Emergency lubrication of the shaft bearings must be provided when this pump is in operation.

Preferably the rotor rotating device is installed at the rear bearing housing of the machine shaft.

DESCRIPTION OF PREFERRED EMBODIMENTS

Figure 1:
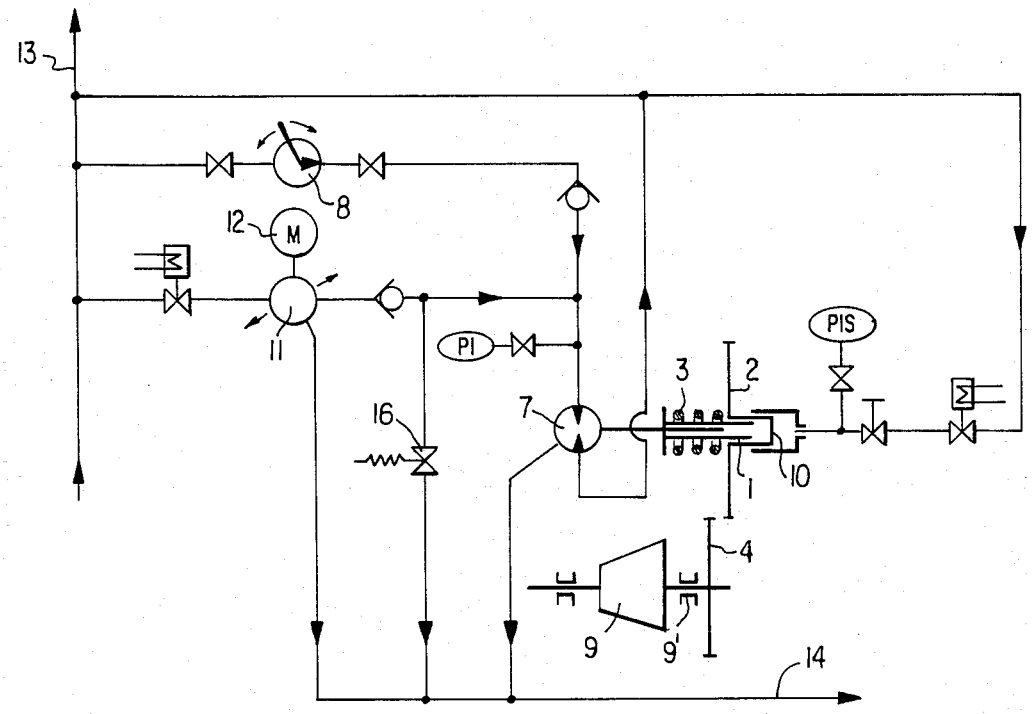
FIG. 1 is a schematic diagram of an oil system incorporating a rotor rotating device according to the invention.

As shown primarily in FIG. 1, the rear bearing housing 9' of the machine shaft of a turbine 9 is provided with a gear wheel 4 which is to be driven by a rotating device according to the invention. One embodiment of this device is shown in FIG. 2.

Figure 2:
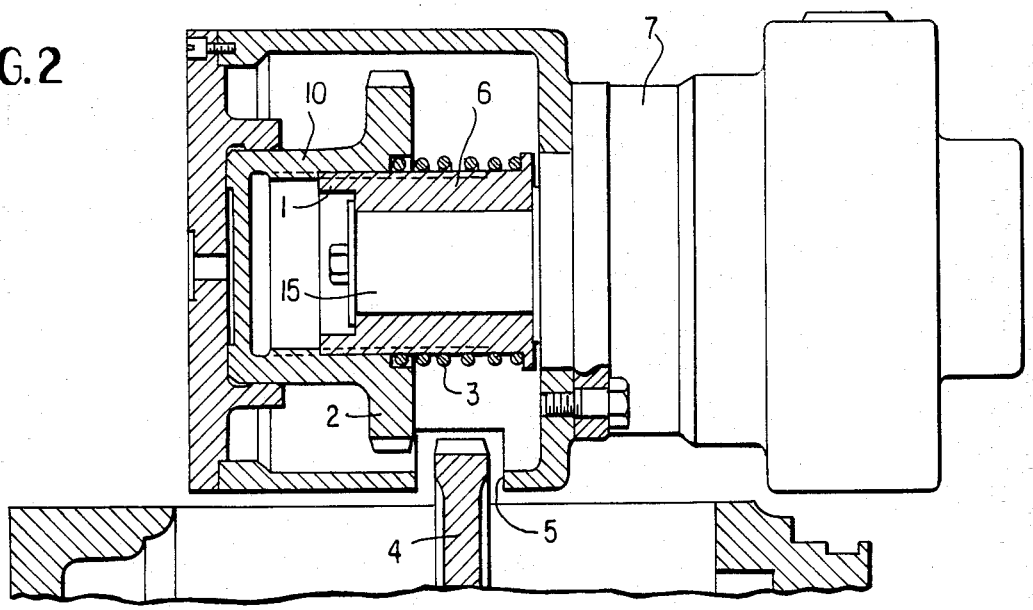
FIG. 2 is an elevational view, partly in cross section, of a preferred embodiment of the device according to the invention.

The embodiment shown in FIG. 2 includes a pinion 2 dimensioned to mesh with gear wheel 4 and fitted to a piston 10. Pinion 2 and piston 10 can be integral with one another. Oil under pressure introduced at the left-hand end of piston 10 drives piston 10 and pinion 2 to the right against the force of a spring 3 and via a screw shift drive 6 so that pinion 2 comes to mesh with gear wheel 4. Then pinion 2 is coupled to screw shift drive 6 on the output shaft 15 of an axial piston motor 7. The piston 10 slides and rotates on a hub 1 which, in the embodiment of FIG. 2 forms part of screw shift drive 6. A spur toothing is provided at the axial location of engagement between pinion 2 and gear wheel 4. On account of this frictional connection between pinion and gear wheel, the further axial movement against the force of the spring 3 up to the machanical stop takes place via the screw shift drive 6 which operates like a normal thread. The connection between pinion 2 and hub 1 corresponds, on principle, to that of a screw-nut-coupling, but with an extremely steep thread. No detailed illustration of the "screw shift drive 6" is given for being self-explanatory.

The frictional connection within the straight toothing between pinion 2 and gear wheel 4 is maintained as long as the axial piston motor 7 has to supply power for turning the rotor. At standstill of the axial piston motor 7 or acceleration of gear wheel 4, the direction of force within the toothing will be reserved so that the effect of the crew shift drive 6 moves the pinion 2 back into its original position. This process is backed up and completed by the spring.

An axial piston motor was selected as driver because its specific properties meet very much the requirements of a rotation device.

1. Slow-speed engine
2. High starting torque
3. Speed directly proportional to the oil flow
4. Undefined as to sense of rotation
5. Compact construction
6. Using oil from the oil supply unit as driving medium
7. Well-known and recognized power engine used by many manufacturers of hydraulic systems.

Arranged in a housing, the structural components described above form a unit of simple design that is provided with a passage 5 for insertion of the gear wheel 4 to be driven. The cell-type vane pump 11 (FIG. 1), together with the drive motor 12 are accommodated independently of the rotor rotating device at a structurally favorable location.

The rotor rotating device according to the invention is connected to the oil supply system of a machine, with the axial piston motor 7, on the one hand, being charged with pressurized oil from the cell-type vane pump 11 or from a hand pump 8, which are likewise connected with the oil supply system 13. The outlet side of the axial piston motor 7 and the pressure face of piston 10 are likewise connected with the oil supply system 13. The rotor rotating device is switched on and off by operation of suitable control valves (not shown in detail). The oil system further includes a low pressure, or return, line 14 to which is delivered leakage oil from the cell-type vane pump 11 and from the axial piston motor 7, and, in the case of possible reverse operation of a compressor or pump, the oil is drained off by means of a safety relief valve 1G (FIG. 1).

The use of an adjustable cell-type vane pump in the rotor rotating device according to the invention has the further advantage that with the same power such pumps supply small flows of oil at high pressures (breakaway) and large flows of oil at low pressures (slow turning).

"Emergency oil supply" is a lube oil supply system with reduced oil flow, which will become effective in the case of a failure of the normal power supply (direct-current driven, for instance). This flow is not sufficient for the operation of the turbine plant, but will serve only for heat dissipation and slow-turning of the rotor with the rotating device. The emergency oil supply is therefore only indirectly connected with the rotor rotating device.

It will be understood that the above description of the present invention is susceptible to various modifications, changes and adaptations and the same are intended to be comprehended within the meaning and range of equivalents of the appended claims.

What is claimed is:

1. Rotor rotating device connected to an oil supply system, for turning the rotor of a rotary machine, which rotor is fitted with a gear wheel, said device comprising: a hydraulic motor; a hub mounted to be rotated by said motor; a pinion mounted on said hub and dimensioned to mesh with the gear wheel; a screw shift drive operatively associated with said pinion for permitting movement of said pinion in the direction of the axis of rotation of said hub between a first position in which said pinion is disengaged from the gear wheel and a second position in which said pinion meshes with the gear wheel; a compression spring disposed to urge said pinion toward said first position; and a piston connected to said pinion and arranged to be actuated by oil under pressure from the oil supply system for moving said pinion into said second position.

2. A device as defined in claim 1 wherein the rotary machine is a steam turbine.

3. A device as defined in claim 1 or 2 wherein: movement of said pinion from said first position to said second position is controlled by said screw shift drive, said screw shift drive is mounted to be rotated by said hydraulic motor, said motor is an axial piston motor arranged to be driven by oil under pressure, and said device further comprises a cell-type vane pump connected to the oil supply system for supplying oil under pressure to said axial piston motor.

4. A device as defined in claim 3 wherein said axial piston motor and said cell-type vane pump are supplied with oil via respective parallel branches of the oil supply system.

5. A device as defined in claim 3 further comprising a hand pump connected to the oil supply system in parallel with said cell-type vane pump for alternatively supplying oil under pressure to said axial piston motor.

6. A device as defined in claim 5 wherein said axial piston motor, said cell-type vane pump and said hand pump are supplied with oil via respective parallel branches of the oil supply system.

7. A device as defined in claim 5 further comprising means for effecting emergency lubrication of the shaft bearings of the rotary machine when said hand pump is employed for supplying oil to said axial piston motor.

8. A device as defined in claim 3 wherein said screw shift drive is provided with a thread having a steep pitch which engages said pinion when said pinion is in the region of said second position.

* * * * *